United States Patent [19]

Carrara

[11] 3,995,587

[45] Dec. 7, 1976

[54] CONTINUOUS CASTING APPARATUS INCLUDING Mo-Ti-Zr ALLOY BUSHING

[75] Inventor: Marcel V. Carrara, Seymour, Conn.

[73] Assignee: General Electric Company, New York, N.Y.

[22] Filed: Sept. 10, 1975

[21] Appl. No.: 612,096

Related U.S. Application Data

[62] Division of Ser. No. 374,760, June 28, 1973, Pat. No. 3,924,036.

[52] U.S. Cl. ..... 118/405; 75/176

[51] Int. Cl.[2] ..... B05C 3/15

[58] Field of Search ..... 118/404, 125, 405, 420, 118/DIG. 18; 164/275; 75/176; 427/356–358, 434 E, 329, 295

[56] References Cited

UNITED STATES PATENTS 2,678,271 5/1954 Ham et al. ..... 75/176

3,610,204 10/1971 Corrigan ..... 118/405

*Primary Examiner*—Morris Kaplan

*Attorney, Agent, or Firm*—R. G. Simkins; P. L. Schlamp; F. L. Neuhauser

[57] ABSTRACT

Apparatus for a process of continuously casting metals by passing a metal core member upwardly through a container of molten metal, and thereby accreting and solidifying molten metal on the core member; and, a method of continuously casting metals. The apparatus comprises a molten metal container or crucible with an entry port in its bottom wall for the passage of the core member. Positioned within the entry port is a bushing member of molybdenum alloyed with titanium and zirconium, and in the method the core member is passed through the molybdenum alloy bushing.

7 Claims, 2 Drawing Figures

CONTINUOUS CASTING APPARATUS INCLUDING Mo-Ti-Zr ALLOY BUSHING

This is a division of application Ser. No. 374,760, filed June 28, 1973, and now U.S. Pat. No. 3,924,036, issued Dec. 2, 1975.

BACKGROUND OF THE INVENTION

This invention relates to an improvement in apparatus for continuous metal casting, or the so-called "dip forming process" of metal casting. The apparatus includes a crucible or refractory container for molten metal which is provided with an entry port or orifice for the introduction and passage of a core member into the crucible or container and through the molten metal contained therein. A bushing member of refractory metal is inserted in the entry port or orifice or provide a relatively wear resistant seal about the moving core member.

The dip forming process of continuously casting by means of passing a core member upwardly through a crucible of molten metal, and apparatus is the subject of many prior U.S. patents, including:

| | | |
|---|---|---|
| 3,008,201 | 3,094,752 | 3,510,345 |
| 3,060,053 | 3,235,960 | 3,538,884 |
| 3,060,054 | 3,424,130 | 3,598,085 |
| 3,060,055 | 3,466,186 | 3,160,204 |
| 3,060,056 | 3,484,280 | 3,709,722 |

The disclosures of these U.S. patents are incorporated herein by reference.

The dip forming process of continuously casting as heretofore practiced and provided for by prior art apparatus, incurred a serious defect in the form of the introduction of contaminating bodies of foreign metal or material into the cast product. The most common source of such bodies of foreign metal or material within the cast product, referred to in this art as "inclusions", appears to be the bushing member in the entry port in the crucible bottom which is utlized as a close fitting seal about the core member as it moves therethrough into the molten contents of the crucible. It appears that particles separate from the bushing member, which is typically composed of a hard refractory material such as sintered molybdenum, and penetrate the core member moving therethrough. These embedded foreign particles or bodies in the core member are then carried through the casting operation wherein they may become completely enveloped within the cast product.

The presence of particles of any foreign metal or other material from the bushing member, or whatever the source, in cast metal products comprises a substantial detriment in subsequent metal working operations such drawing, rolling, forging, extruding, and the like, and in the products derived therefrom. Moveover, the dip forming process of continuously casting is primarily utilized in commercial manufacturing operations for the production of copper rod for use in drawing electrical conducting wires. The existence of any foreign particles, and especially of a very hard material such as molybdenum, in copper rods presents an especially serious impediment in the drawing of wire inasmuch as their presence causes frequent breakages in the extending strands, thereby disrupting the production system, or resulting in weakened and inferior wire products. Also, the passage of relatively hard particles such as molybdenum entrained in copper through drawing dies or reducing rolls, and other metal working apparatus, is detrimental to such equipment.

SUMMARY OF THE INVENTION

This invention comprises an improvement in the apparatus for carrying out a continuous metal casting or dip forming process comprising passing a core member upwardly through a crucible containing molten metal, whioh substantially eliminates the occurrence of entrained particles or bodies of foreign metal or material, so-called inclusions within the cast products.

The improvement of this invention includes providing a bushing member insert for the crucible entry port composed of molybdenum alloyed with minor amounts of both titanium and zirconium, and passing the core member through the bushing into the crucible.

OBJECTS OF THE INVENTION

A primary object of this invention is to provide an apparatus for continuously casting metal which effectively overcomes the entrainment of particles of foreign metals or other materials within the cast product, and thereby produces a cast product free of degrading contaminants.

Another object of this invention is to extend production runs in continuous casting operations, and reduce downtime for replacement of parts by providing apparatus including a bushing insert which resists deterioration and loss of structural integrity.

A further object of this invention is to provide for the production of relatively pure continuously cast products which are more amenable to metal working or shaping procedures, and apparatus therefor.

DETAILED DESCRIPTION OF A PREFERRED EMBODIMENT

Figure 1:
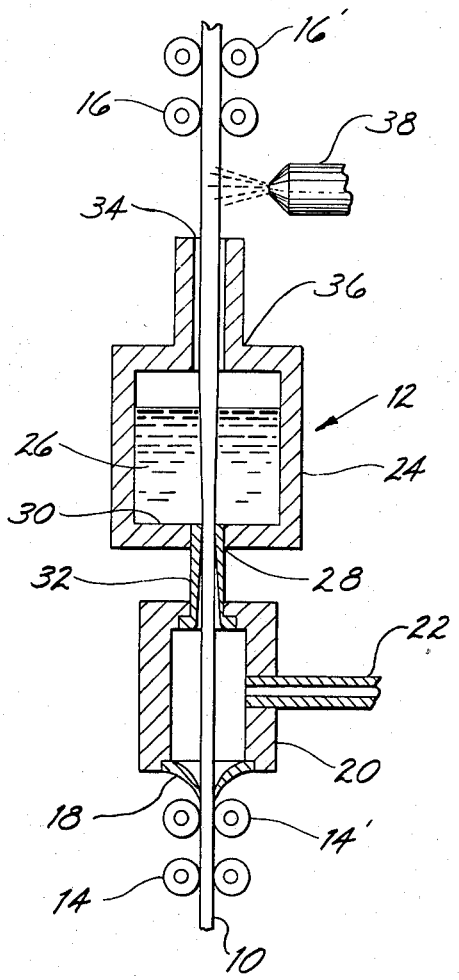
FIG. 1 is a cross-sectional view of a novel apparatus constructed in accordance with one embodiment of this invention, with the core member and cast product shown in elevation; and, FIG. 2 is an enlarged fragmentary view of a portion of the apparatus shown in FIG. 1 with the core member and the cast product shown in elevation.
Figure 2:
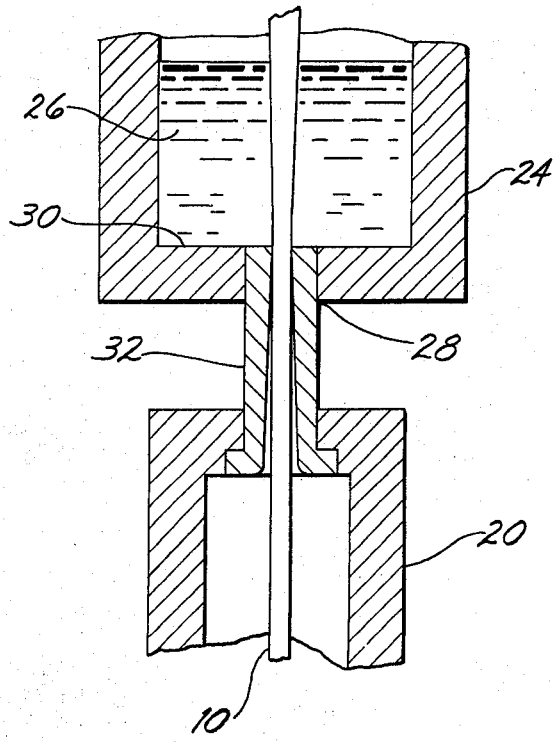

Referring to the drawing, a metal core member 10, such as a rod of copper, is continuously passed upwardly through the apparatus of a continuous casting system 12. The core member can be moved through the apparatus by appropriate drive means such as feed rolls 14 and 14', and take up rolls 16 and 16'. Core member 10 is preferably first passed through an annular cutting die 18 which continuously shaves off a portion of the outer surface area of the core member to eliminate surface oxides or contaminants and to provide a clean metal face for the adherence of the molten metal. Other means, such as an acid pickling bath, can serve to effectively clean the surface of the core member. However, the annular cutting die 18 is a preferred means because among other reasons, it also performs a sealing function at the systems entrance.

Passing from the cutting die 18, the shaved and cleaned core member 10 enters a vestibule chamber 20, which is preferably evacuated, such as through pipe 22, to minimize exposure of the shaved core member to oxygen and other air borne contaminants.

Crucible 24, comprising a suitable refractory vessel for the containment of molten metal 26, such as copper, is preferably enclosed to protect is contents from the atmosphere. Crucible 24 is provided with an entry port of orifice 28 located in its bottom wall 30 below the surface ot its molten metal contents for passage therethrough of the core member 10 upwardly into the crucible chamber interior, and through its contents of molten metal 26. A bushing member or insert 32 formed of a refractory material is provided within entry port 28 of crucible 24, and in accordance with one preferred embodiment of the invention, the bushing member extends from the vestibule chamber 20 to the crucible 24 substantially as shown in the drawing.

In accordance with this invention, bushing member or insert 32, provided for the passage therethrough of the core member into the crucible, is composed of, or formed from, molybdenum metal alloyed with minor amounts of both titanium ahd zirconium, for example at least about 99 percent by weight of molybdenum with about 0.25 to 1.0 percent by weight of titanium and about 0.04 to 0.2 percent by weight of zirconium. In accordance with the preferred embodiment of the invention, the bushing member 32 is composed of an alloy consisting essentially of about 0.48 percent by weight of titanium and about 0.9 percent by weight of zirconium, and the balance molybdenum.

It has been discovered that bushings or inlet port inserts composed of the aforesaid molybdenum alloys effectively eliminate the occurrence of inclusions or presence of particles of foreign metal or other material within the cast products derived therefrom. Moreover the bushing member formed of these alloys have been found to provide exceptionally longer periods of service life of up to several times greater than prior bushings composed of other refractory materials such as sintered molybdenum.

On passing through the bath of molten metal 26 with the apparatus of this invention, the relatively cold core member 10 progressively accretes over its surface an accumulation of solidfying melt. The core member then passes out of the crucible 24 up through an exit port 34 or orifice in the top wall 36 of the crucible 24. Upon exiting from the crucible chamber, the cast product moves through a water spray 38, or other suitable cooling means to reduce the temperature of the cast product.

Prior to the above-reference discovery that the occurrence of inclusions or bodies of foreign material can be virtually eliminated by the use of bushing inserts composed of the particular alloys of molybdenum, breaks in the drawing of copper wire from cast copper rods produced by the dip forming process were a relatively common occurrence due to the presence of included particles of foreign material. After the use of the bushing inserts of the molybdenum alloy in the production of dip formed continuously cast copper rod, no breaks or interruptions caused by inclusions or foreign particles were found over a period of several months of wire drawing production, and running time of the wire drawing production machines was increased about 20 percent.

Molybdenum alloys of the type which are suitable for use in forming the bushing members or inserts of this invention for use in dip forming apparatus and production, are reported in Alloy Digest, August 1964, Published by Engineering Alloy Digest Inc., Upper Montclair, New Jersey. The compositions of commercial sources of the alloys are given therein as follows:

| | |
|---|---|
| Titanium | 0.40 – 0.55 |
| Zirconium | 0.06 – 0.12 |
| Carbon | 0.01 – 0.04 |
| Oxygen | 0.0025 max. |
| Hydrogen | 0.0005 max. |
| Nitrogen | 0.002 max. |
| Molybdenum | 99.25 min. |

Although copper has been mentioned in the foregoing description of an embodiment of this invention, the apparatus and method of this invention are useful in the casting of other metals. For example, the invention can be used in the casting of substantially any metal or alloy upon a core member composed of the same metal or alloy as the melt, or a different metal or alloy, and may include plating or encasing operations.

In addition to overcoming the problem of "inclusions", the molybdenum alloy insert of this invention also eliminates some of the causes of the formation of "bells" which comprise intermittent over-accretions or attachments of excessive and irregular accumulations of molten metal on the moving core member. For instance the molybdenum alloy insert provides much greater resistance to wetting by the molten copper and in turn adherence and build up of cooled melt adjacent to the core rod passing through the insert. Moreover the alloys freedom from high oxide contents eliminates a source of chilling the copper melt in the area about the core rod.

Although the invention has been described with reference to certain specific embodiments thereof, numerous modifications are possible and it is desired to cover all modifications falling within the spirit and scope of this invention.

What I claim as new and desire to secure by Letters Patent of the United States is:

1. Apparatus for the continuous casting of metals by passing a metal core member upwardly through a crucible containing molten metal and thereby accreting and solidifying molten metal on the core member, comprising: a crucible for the containment of molten metal having an entry port below the surface of said molten metal contents for the passage of a metal core member into the crucible and through the contents thereof, said entry port having positioned therein a bushing member consisting essentially of a molybdenum alloy containing minor amounts of titanium and zirconium.

2. The apparatus of claim 1, wherein the molybdenum alloy contains about 0.25 to 1.0 percent by weight of titanium and about 0.04 to 0.2 percent by weight of zirconium.

3. The apparatus of claim 1, wherein the molybdenum alloy contains about 0.40 to 0.55 percent by weight of titanium and about 0.06 to 0.12 percent by weight of zirconium.

4. Apparatus for the continuous casting of copper by passing a metal core member comprising copper upwardly through a crucible containing molten copper and thereby accreting and solidifying molten copper on the core member, comprising: a crucible having enclosing walls defining a closed chamber for the containment of molten copper; said crucible walls including a bottom wall provided with an entry port and a top wall provided with an exit port for the passage of a metal core member comprising copper up through the closed chamber of the crucible and the molten copper contents thereof; and a refractory bushing member positioned within the entry port of the bottom wall of the crucible, said refractory bushing member consisting essentially of a molybdenum alloy containing minor amounts of titanium and zirconium.

5. The apparatus of claim 4, wherein the molybdenum alloy contains about 0.25 to 1.0 percent by weight of titanium and about 0.04 to 0.2 percent by weight of zirconium.

6. The apparatus of claim 5, wherein the molybdenum alloy contains about 0.40 to 0.55 percent by weight of titanium and about 0.06 to 0.12 percent by weight of zirconium.

7. The apparatus of claim 5, wherein the molybdenum alloy comprises at least about 99.25 percent by weight of molybdenum, and approximately 0.48 percent by weight of titanium and approximately 0.09 percent by weight of zirconium.

* * * * *